United States Patent [19]

Reese et al.

[11] Patent Number: 4,999,939

[45] Date of Patent: Mar. 19, 1991

[54] BREECH LOAD PISTOL AND CONVERSION

[75] Inventors: Robert R. Reese, Colona, Ill.; Robert A. Kuehl, Davenport, Iowa

[73] Assignee: Springfield Armory, Inc., Geneseo, Ill.

[21] Appl. No.: 439,460

[22] Filed: Nov. 20, 1989

Related U.S. Application Data

[62] Division of Ser. No. 139,920, Dec. 31, 1987, now U.S. Pat. No. 4,914,845.

[51] Int. Cl.[5] ..... F41A 21/00

[52] U.S. Cl. ..... 42/40; 42/75.02; 42/75.03; 42/75.04

[58] Field of Search ..... 42/40, 75.02, 75.03, 42/75.04

[56] References Cited

U.S. PATENT DOCUMENTS

| | | | |
|---|---|---|---|
| 161,307 | 3/1875 | Watson | 42/40 |
| 200,322 | 2/1878 | Mauser | 42/40 |
| 688,216 | 12/1901 | Whiting | 42/63 |
| 889,279 | 6/1908 | Warnant | 42/44 |
| 999,209 | 8/1911 | Cobb | 42/68 |
| 1,507,411 | 9/1924 | Zugaja | 42/44 |
| 1,719,384 | 7/1929 | Tansley | 42/70.02 |
| 1,840,054 | 1/1932 | Reising | 42/75.02 |
| 2,744,448 | 5/1956 | Allen | 42/75.04 |
| 3,153,874 | 10/1964 | Merrill | 42/41 |
| 3,561,149 | 2/1971 | Center | 42/40 |
| 4,021,955 | 5/1977 | Curtis | 42/70.08 |
| 4,156,980 | 6/1979 | Aspenwall | 42/44 |
| 4,602,450 | 7/1986 | Hoenig | 42/77 |

FOREIGN PATENT DOCUMENTS

| | | | |
|---|---|---|---|
| 480058 | 4/1953 | Italy | 42/40 |

OTHER PUBLICATIONS

Pachmayr, Ltd. Catalog, The Dominator TM, (4 pages), 1875 South Mountain Ave., Monrovia, Calif. 91016.

American Rifleman Magazine, Mar., 1987 issue, Article "Hunter's Pistol–Family Style", by Charles E. Petty, cover page, pp. 24–26 and 76.

*Primary Examiner*—Michael J. Carone

*Attorney, Agent, or Firm*—Woodard, Emhardt, Naughton, Moriarty & McNett

[57] ABSTRACT

A breech load pistol and conversion kit which may be adapted to the frame of a semi-automatic pistol, such as a Government 0.45 pistol. The present invention may provide a modified reinforced slide which is slidably mounted to the pistol frame and is adapted to include a pivotable barrel assembly mounted thereto. The barrel preferably is suitable for target pistol accuracy. The barrel assembly may be pivoted exposing the breech end for single shot loading for target shooting applications. The conventional semi-automatic pistol magazine or clip may be replaced with a modified clip acting as a breech release actuator having a lever mechanism which is operable to release a latch holding the barrel assembly in engagement with the slide. The present invention also provides a pistol with a gas relief port. The present invention further provides a rim ejector for ejecting spent cartridges using a camming action occurring during pivoting of the barrel assembly to a loading position.

11 Claims, 4 Drawing Sheets

BREECH LOAD PISTOL AND CONVERSION

This application is a division of application Ser. No. 139,920, filed Dec. 31, 1987, now U.S. Pat. No. 4,914,845.

BACKGROUND OF THE INVENTION

The present invention relates generally to firearms, and more specifically to a breech load pistol and conversion assembly having a pivotally mounted barrel adapted to pivot between a firing position and a load position.

Pistol shooting, including target pistol shooting, often involves the use of specialized firearms. Furthermore, certain competitive pistol shooting events are well-suited for large caliber pistols, such as 0.45 caliber pistols. Consequently, it is desirable to provide a target pistol having a large caliber in certain situations.

Furthermore, semi-automatic pistols, such as a Government Colt 0.45 semi-automatic pistol, are widely available and relatively popular. The same is true for other semi-automatic slide/action pistols. Unfortunately, such slide/action semi-automatic pistols provide less than optimal accuracy, making them less well-suited for target pistol usage. However, it becomes expensive to purchase separate pistols, a target pistol and a semi-automatic pistol, for a person wanting to have the advantages of both types of firearms.

Also, present pistol designs of which I am aware are limited in strength and unable to properly support discharge of extra large cartridges, such as 0.308 and 0.30-06.

The present invention provides a unique combination of elements addressing shortcomings of previous pistols. Other firearms have been developed which address some of the features of the present invention. The Pachmayr "Dominator TM" target pistol provides a bolt action target pistol. A semi-automatic pistol frame is combined with a barrel mechanism having a bolt action for loading. The barrel mechanism is slidably disposed on the pistol frame for converting the frame from a semi-automatic mode to a target pistol mode. Such firearms are offered by Pachmayr Limited, 1875 South Mountain Avenue, Monrovia, Calif. 91016.

U.S. Pat. No. 3,153,874 to Merrill discloses a hinged barrel firearm with trigger safety means. The Merrill pistol is a breech loaded target pistol in which the barrel pivots upwardly for single round loading. The Merrill pistol has a solid grip or butt-stock. A later embodiment of the pistol of U.S. Pat. No. 3,153,874 appears in the Mar. 1987 American Rifleman Magazine at page 24. U.S. Pat. No. 1,719,384 to Tansley discloses a typical slide/action pistol having a removable clip. Removal of the clip disables the gun, and thus acts as a safety mechanism. U.S. Pat. No. 4,021,955 to Curtis discloses a Colt 0.45 pistol frame including a disconnect. Although each of these pistols provide certain advantages, none of them provide the same advantages in the same way as the present invention.

The present invention provides a conversion barrel mechanism, enabling the user to take a pre-existing slide action semi-automatic pistol frame and turn it into a more accurate breech load target pistol. One advantage of such conversion is that certain jurisdictions, such as some European countries, limit the number of handguns sold. By providing a conversion, the gun owner extends the utility of his semi-automatic pistol frame without having to declare ownership of a second pistol.

The present invention also provides an open top slide having a novel structure to strengthen the breech block assembly therein against flexure. Also, a primer gas relief port allows escape of gas from a failed primer in the pistol. Although virtually all high-powered rifles have gas relief ports somewhere in their receivers, to my knowledge there are no pistols made with gas relief ports. Furthermore, the present invention provides a safety interface member slidably disposed with respect to the slide and the pistol frame. This member engages and disengages the disconnector in the frame to provide a safety against hammer release when the pistol is not in firing position.

SUMMARY OF THE INVENTION

According to one embodiment, the present invention provides a breech load pistol comprising a frame having a trigger/hammer assembly, a grip, and a longitudinal slide mount; a longitudinal slide disposed on the slide mount, the slide including a receiver body; means for securing the longitudinal slide against longitudinal movement with respect to the frame during firing of the pistol; a barrel assembly including a barrel having a muzzle end and a breech end; the barrel assembly being seated on the longitudinal slide by a pivot means for pivoting the barrel with respect to the longitudinal slide between a firing position and a loading position; and a breech latch means for preventing the barrel assembly from pivoting between the firing position and loading position, the breech latch means having a latched position wherein the barrel assembly is prevented from pivoting between the firing position and loading position and an unlatched position wherein the barrel assembly is not prevented by the breech latch means from pivoting between the firing position and loading position.

The present invention also provides a pistol conversion assembly adapted to be mounted to a pistol frame having a trigger/hammer assembly, a grip, and a longitudinal slide mount comprising a longitudinal slide including means adapted for mounting to the longitudinal slide mount, the slide including a receiver body; a barrel assembly including a barrel having a muzzle end and a breech end; the barrel assembly being seated on the longitudinal slide by a pivot means for pivoting the barrel with respect to the longitudinal slide between a firing position and a loading position; and a breech latch means for preventing the barrel assembly from pivoting between the firing position and loading position, the breech latch means having a latched position wherein the barrel assembly is prevented from pivoting between the firing position and loading position and an unlatched position wherein the barrel assembly is not prevented by the breech latch means from pivoting between the firing position and loading position.

The present invention also provides a pistol conversion assembly adapted to be mounted to a pistol frame having a trigger/hammer assembly, a grip having a magazine well, and a longitudinal slide mount comprising a longitudinal slide including means adapted for mounting to the longitudinal slide mount, the slide including a receiver body; a barrel assembly including a barrel having a muzzle end and a breech end; the barrel assembly being seated on the longitudinal slide by a pivot means for pivoting the barrel with respect to the longitudinal slide between a firing position and a loading position; a breech latch means for preventing the barrel assembly from pivoting between the firing position and loading position, the breech latch means having a latched position wherein the barrel assembly is prevented from pivoting between the firing position and loading position and an unlatched position wherein the barrel assembly is not prevented by the breech latch means from pivoting between the firing position and loading position; and breech release actuator means disposable in the magazine well, the breech release actuator means when disposed in the magazine well being engageable with the breech latch means and operable to move the breech latch means into the unlatched position.

The present invention also provides in a breech load pistol including a frame assembly having a trigger/hammer assembly, a grip with a magazine well therein; a barrel assembly including a barrel mounted to the pistol frame assembly, a pivot between the barrel assembly and the frame assembly, wherein the barrel assembly is pivotable with respect to the frame assembly between a firing position and a loading position, and a breech latch means having a latched position wherein the barrel assembly is prevented from pivoting between the firing position and loading position and an unlatched position wherein the barrel assembly is not prevented by the breech latch means from pivoting between the firing position and loading position, a breech latch actuator comprising a housing adapted to be inserted into the magazine well of the grip; and breech release actuator means disposed in the housing, the breech release actuator means when the housing is disposed in the magazine well being engageable with the breech latch means and operable to move the breech latch means into the unlatched position.

The present invention also provides a pistol comprising a frame assembly having a trigger/hammer assembly, and a pistol grip; a barrel assembly coupled to the frame assembly and including a barrel having a muzzle end and a breech end; a receiver body coupled to the frame assembly and positioned rearward of the breech end of the barrel, the receiver body having a centerfire firing pin therein, the receiver body further having a gas release port therein for releasing pressurized gas from the breech end of the barrel.

An object of the present invention is to provide an improved breech load pistol and conversion.

Related objects of the present invention are disclosed in the following description of the preferred embodiments.

DESCRIPTION OF THE PREFERRED EMBODIMENT

Figure 1:
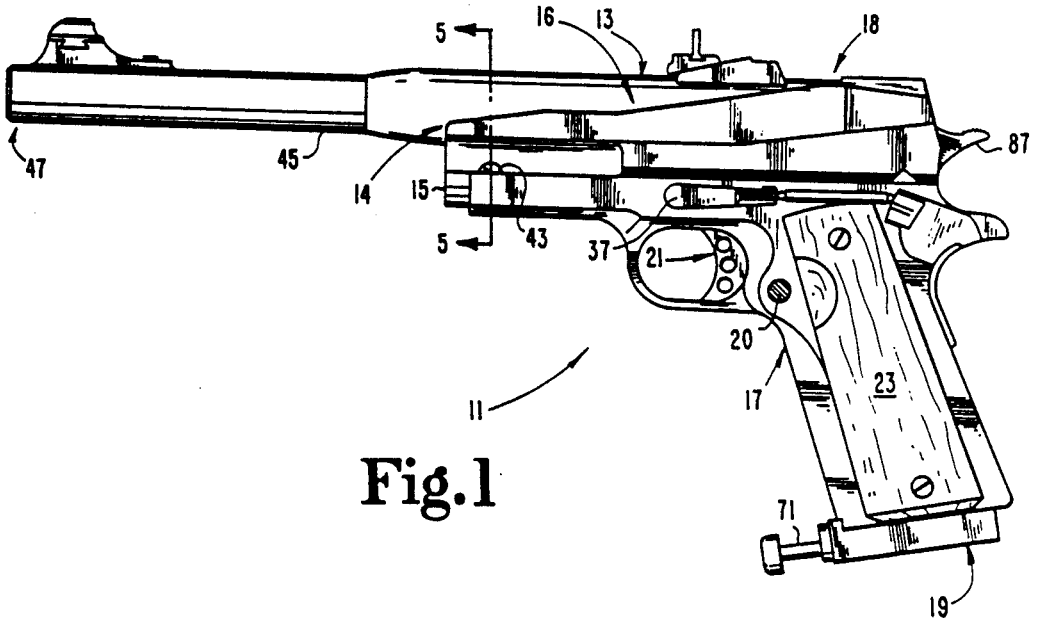
FIG. 1 is a side view of the preferred embodiment of the pistol of the present invention in a firing position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, such equivalents, and such further applications of the principles of the invention as illustrated therein being contemplated as would normally occur to one skilled in the art to which the invention relates.

Figures 3, 5, 6:
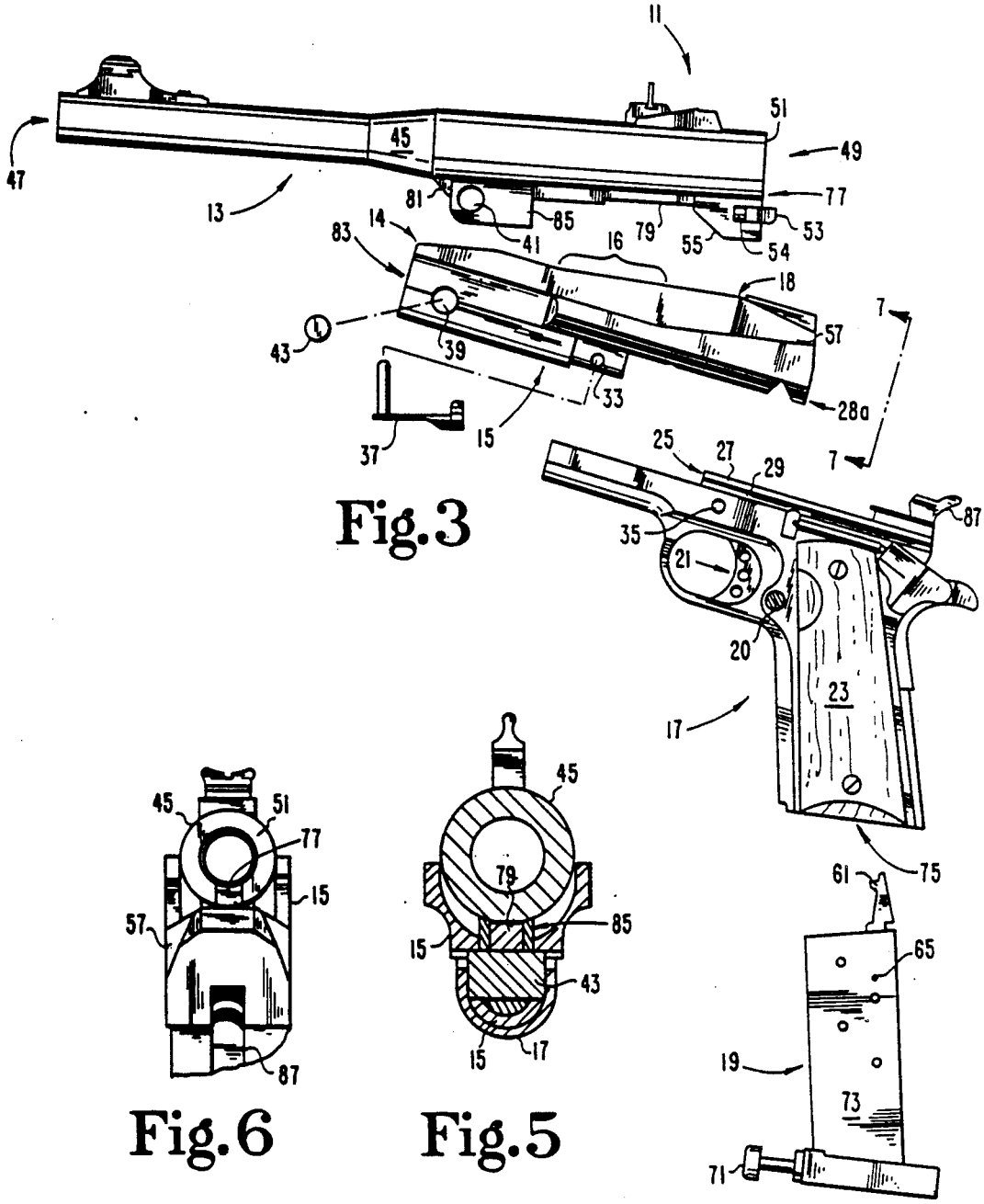
FIG. 3 is a partially exploded side view of the pistol of FIG. 1.
FIG. 5 is a rear view in full section taken along line 5—5 of FIG. 1.
FIG. 6 is a partial top-rear view of the preferred embodiment of the pistol of the present invention taken from the perspective of line 6—6 of FIG. 2.

Referring now to FIGS. 1–7, pistol 11 includes barrel assembly 13, longitudinal slide 15, frame 17 and breech release actuator 19. Frame 17 and slide 15, and their equivalents, collectively define a frame assembly. In the preferred embodiment, frame 17 is a standard Government 0.45 semi-automatic slide action pistol frame having a trigger/hammer assembly 21, a pistol grip 23, and a longitudinal slide mount 25 as is known in the art. Longitudinal slide mount 25 includes a pair of guide rails, such as guide rail 27, with grooved guide way 29 disposed thereunder (see FIG. 3). Slide 15 includes guide ways at **28*a* and 28*b* (see FIG. 7) machined therein to receive and slide over longitudinal slide mount 25. Thus, the slide mount receives slide 15 thereon to operably couple the slide to the frame. Guide rail 27 slides longitudinally into guide rail guide way 28*a*; and, slide guide rail 30*a* (see FIG. 7) slides longitudinally into guide way 29 of frame 17 as seen in FIG. 3. Slide 15's guide rail 30*b* and guide way 28*b* slide into engagement with a corresponding guide rail/grooved guideway (like rail 27 and guideway 29) on frame 17 as is known in the construction of semi-automatic slide action pistol frames. Slide 15 is moved rearwards onto the frame until transverse hole 33 aligns with transverse hole 35 on the frame. Holes 33 and 35 are aligned so that shear pin 37 is disposed therein for securing a longitudinal slide against longitudinal movement with respect to the frame during firing of the pistol as well as other times. In this respect, slide 15 differs from a conventional semi-automatic slide which, by design, moves rearwardly upon firing to mechanically discharge an empty cartridge from the chamber. Note that in FIG. 3, pin 37 is shown from a top view for drawing clarity, but is rotated 90° when inserted as illustrated in FIG. 1. Pin 37** is a conventionally known part used in semi-automatic pistols such as a Government 0.45.

Longitudinal slide 15 also has transverse hole 39 which is aligned with transverse hole 41 in the barrel assembly 13. Upon alignment of holes 39 and 41, pivot pin 43 is inserted therein to hold the barrel assembly and slide together, the barrel assembly seated on the slide. The pivot pin is disposed through the longitudinal slide and barrel assembly, wherein the barrel assembly is pivotable with respect to the longitudinal slide about the pin to a load position shown in FIG. 2 and to a firing position (or breech closed position) shown in FIGS. 1 and 4.

Barrel assembly 13 includes barrel 45 which has a rifled longitudinal bore therethrough, 0.45 caliber in the preferred embodiment. Other calibers may be utilized with the present invention, such as 9 mm or other suitable sizes. Barrel 45 also includes a muzzle end 47 and a breech end 49 rearward thereof. The barrel is preferably long for improved accuracy, about ten and one-half inches, from muzzle end 47 to breech end 49 in the preferred embodiment illustrated. Ordinarily, the barrel will be at least in excess of seven inches long. At the breech end, the barrel includes a breech surface 51 against which the rim of a round to be fired bears against. The barrel assembly also includes a breech latch 53 which is disposed in a breech latch housing 55 coupled to the bottom of the barrel at the breech end. The breech latch 53 is biased by a compressional spring 54 to a rearward/outward orientation as shown in FIG. 3. Latch 53 reciprocally moves in housing 55, such that the rearward face of latch 53 can be made flush with breech surface 51.

Figure 4:
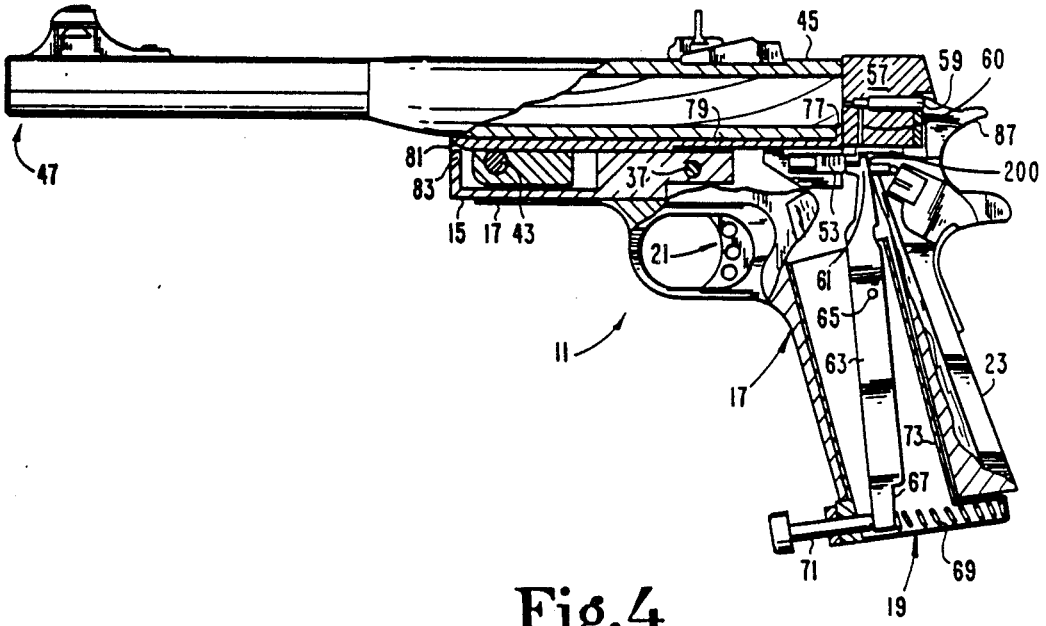
FIG. 4 is a partially cutaway side view of the pistol of FIG. 1 in a firing position.

Slide 15 includes receiver body 57 integrated therein and fixed with respect thereto. Receiver body 57 is that portion of slide 15 positioned rearward of breech surface 51 in the firing position. As shown in FIG. 4, breech latch 53 is biased rearwardly under receiver body 57, resisting upward pivoting of barrel 45 about pin 43. Note that receiver body 57 has centerfire firing pin 59 disposed therein in a firing pin bore. Receiver body 57 provides a solid, substantial body to both house centerfire firing pin 59 and to receive the recoil caused by the discharge of a round. Due to the significant stresses developed, especially with high powered rounds, slide 15 includes tapered reinforcing portion 16. Reinforcing portion 16, in the preferred embodiment, tapers from upper rearward location 18 to lower forward position 14. This reinforcing portion 16 significantly adds to the rigidity and flexure resistance of the slide with its receiver body 57.

Note that a symmetric reinforcing portion is present on the right hand side of slide 15. Reinforcing portion 16 has been found to increase the strength of the breech block assembly including receiver body 57 by more than two-fold over earlier designs. Such designs typically have somewhat squared corners at the lower-forward juncture of the receiver body and the frame as illustrated near reference number 24 of FIG. 4 of U.S. Pat. No. 3,153,874 to Merrill. By bridging upper rearward location 18 to lower forward position 14 of the present invention, rigidity of the present invention is significantly enhanced. Note that preferably, lower forward position 14 is forward of trigger/hammer assembly 21 near front bearing surface 83. Upper rearward position is near the upper and forward most edge of receiver body 57. As shown, barrel 45 has iron sites, but may be provided with a scope or other suitable siting means. A muzzle brake may optionally be provided.

As shown in FIG. 4, breech latch 53 is engaged by upper end 61 of breech release lever 63. Lever 63 pivots around pivot pin 65 and has lower end 67. Lower end 67 engages helical spring 69 which provides compressional resistance against rearward movement of lower end 67. Plunger 71 engages lower end 67 and provides a manually depressible mechanism by which lower end 67 can be urged against compressional helical spring 69. By depressing plunger 71 rearward, lever 63 pivots around pin 65 and causes upper end 61 to move forward. As upper end 61 moves forward, its curved camming surface along its front face depresses breech latch 53 forwardly against rearward biasing compression spring 54 into breech latch housing 55. In this position, latch 53 no longer provides shear resistance against upward movement of barrel 45 with respect to receiver body 57. Thus, barrel 45 may be pivoted about pin 43, exposing the breech for single shot loading.

Note that breech release actuator 19 includes a breech release housing 73 which, in the preferred embodiment, corresponds to the shape and size of a standard magazine clip insertable in grip 23 of frame 17. Housing 73 is upwardly inserted into magazine well 75 (see FIG. 3) in grip 23. Although breech release housing 73 can have solid side walls as seen in FIG. 3, it may alternatively comprise a frame structure in which lever 63 is more readily visible as illustrated in the alternative embodiment of FIG. 8. With the breech release actuator disposable in the magazine well, and with the presence of lever 63, breech release actuator 19 does not have room to carry additional rounds of ammunition. Consequently, in the preferred embodiment, the present invention is adapted for single shot target pistol usage in which each round is individually hand loaded into the breech of the barrel. The breech release actuator is removable from frame 17 by depression of the magazine release button 20 on the side of frame 17 as is known. Note however, when actuator 19 is removed from frame 17, it is difficult or impossible to open barrel 45 to a load position, providing a further safety mechanism.

Figure 2:
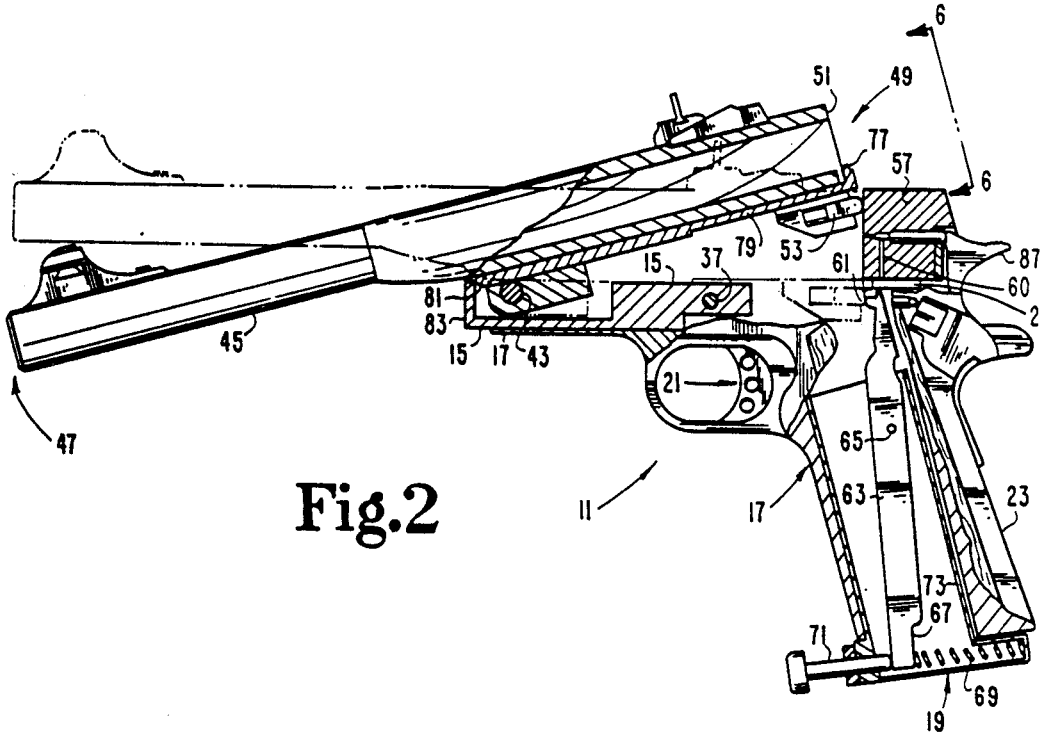
FIG. 2 is a partially cutaway side view of the pistol of FIG. 1 in a loading position.
Figure 7:
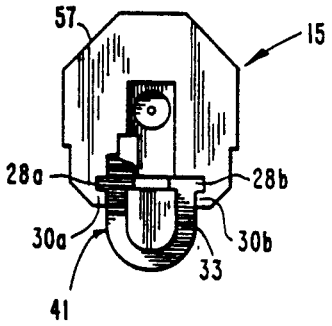
FIG. 7 is a rear view of the slide of the preferred embodiment of the pistol of the present invention taken from the perspective of line 7—7 of FIG. 3.

Gas relief port 60 is drilled through receiver body 57, intersecting the firing pin bore which houses firing pin 59 just forward of the shoulder of the firing pin (see FIGS. 2 and 4). Gas relief port 60 is preferably slightly larger in diameter than the forward portion of the firing pin bore, which allows gases to escape if a primer should rupture. Although port 60 is illustrated as being vertically drilled from the bottom of receiver body 57, it may be drilled from any number of angles and more than one port may be provided.

To assist in ejection of a spent cartridge, rim ejector 77 is provided. Ejector 77 is embedded in breech surface 51 and is reciprocally movable to the rear upon opening of the barrel to the load position. The rim ejector hooks under the lip of the rim of a cartridge in the breech and lifts it axially out of the bore of the barrel, either completely throwing it clear of the barrel or at least removing the spent cartridge sufficient to allow the operator to grasp the spent cartridge around the rim. Rim ejector 77 is coupled to a reciprocating longitudinal arm 79 having a front camming surface 81. Arm 79 is typically spring biased to a forward position as shown in FIG. 4. Camming surface 81 of arm 79 engages and cams against the top surface of the slide's front bearing member 83 when the barrel is pivoted about pivot 43. The downward sloping slant of front camming surface 81 bears against member 83's surface forward of pivot 43, causing a camming action which causes reciprocating longitudinal arm 79 to move rearwardly. Consequently, rim ejector 77 is moved rearwardly, causing ejection of a spent cartridge as the barrel is opened. Note that, as shown in FIG. 5, arm 79 is nested under barrel 45 and is located within barrel assembly pivot mount 85.

Figure 8:
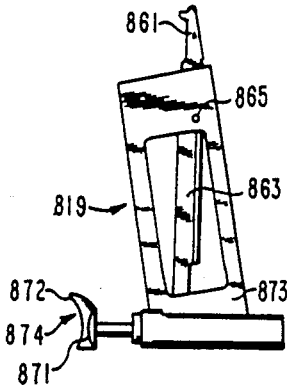
FIG. 8 is a side view of an alternative embodiment of the breech release actuator of the present invention.
Figure 9:
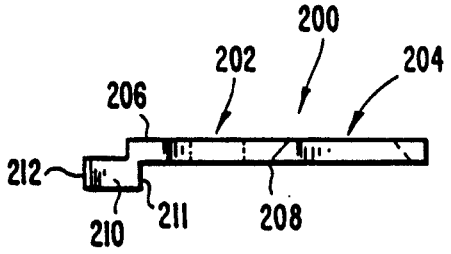
FIG. 9 is a side elevation view of a safety interface member used in the preferred embodiment of the pistol of the present invention.
Figure 11:
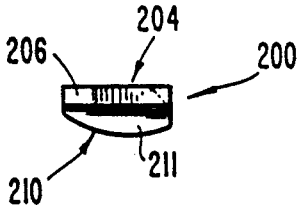
FIG. 11 is a rear elevation view of a safety interface member used in the preferred embodiment of the pistol of the present invention.
Figure 10:
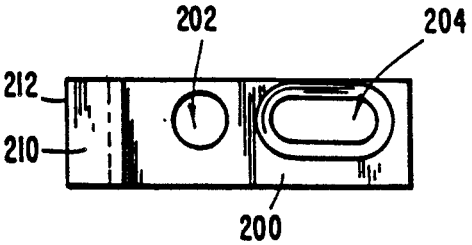
FIG. 10 is a bottom view of a safety interface member used in the preferred embodiment of the pistol of the present invention.

Referring now to FIG. 8, an alternative embodiment of the breech release actuator of FIGS. 1–4 is shown. Breech release actuator 819 includes breech release housing 873, breech release lever 863 with upper end 861, plunger 871 with lip 872 and cusp 874, and breech release pivot pin 865. Actuator 819 is similar to actuator 19 except that actuator has lip 872 which partially defines cusp 874 for receiving the operator's lowermost finger, and that actuator 819's housing 873 has a generally rectangular hole therein, exposing lever 863. The positioning of the plunger allows the user to actuate the plunger while the user's hand is holding the grip and is also in a position to pull the trigger.

The present invention provides an additional safety mechanism to take advantage of the safety disconnect present in many pistol frames. Referring now to FIGS. 9–12, safety interface member 200 is illustrated in detail. Interface member 200 is also illustrated in FIGS. 2 and 4 in pistol 11. Interface member 200, in the preferred embodiment, includes upper plate 206 and lower plate 210. Upper plate 206 has round hole 202 and oblong tapered hole 204 machined therein (shown in phantom lines in FIGS. 9 and 11). Upper plate 206 also has bottom face 208 which engages the disconnect 216 of the pistol. Lower plate 210 has front face 212 and rear face 211.

Figure 12:
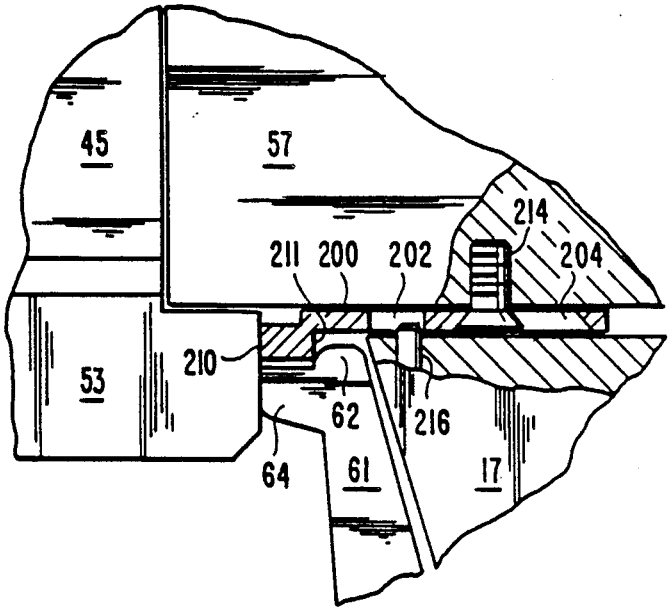
FIG. 12 is a side partial cutaway detail view of a safety interface member positioned in the preferred embodiment of the pistol of the present invention.

In the preferred embodiment, upper plate 206 is 0.062 inches thick, and lower plate 210 is 0.093 inches thick, with the overall length of interface member 200 being 0.975 inches. As illustrated in FIG. 12, interface member 200 is suspended below receiver body 57 by tapered head screw 214. Receiver body 57 is machined on its bottom side to provide sufficient room between it and frame 17 to receive interface member 200. The tapered head of screw 214 corresponds to the tapers in oblong tapered hole 204. However, due to the round shape of screw 214 and the oblong shape of hole 204, interface member 200 is reciprocally slidable forwards and backwards with respect to receiver body 57 and with respect to pistol frame 17.

Disconnector 216 is reciprocal up and down and is similar to the disconnect illustrated in U.S. Pat. No. 4,021,955 to Curtis which is hereby expressly incorporated by reference. Similarly, disconnect 216 has a cammed top surface to facilitate downward movement of disconnect 216 upon forward movement of interface member 200. Accordingly, when upper end 61 of the breech release lever moves forward, tab 62 bears against rear face 211 of interface member 200, causing front face 212 of the interface member to push breech latch 53 forward. Simultaneously, round hole 202 and bottom face 208 of interface member 200 cam against the top camming surface of disconnect 216, forcing disconnect 216 downward. Also, tab 64 bears directly against breech latch 53. As is known, when disconnect 216 is in a downward position, the pistol cannot fire. Accordingly, when the breech release lever 63 is actuated, and/or when the pistol is in a loading position, interface member 200 is in a forward position preventing discharge of the firing mechanism. Conversely, when the barrel is closed to a firing position, spring biased breech latch 53 urges interface member 200 rearwardly, allowing disconnect 216 to spring upward into round hole 202, enabling the pistol to be fired.

It should be noted that interface member 200 may have a variety of geometries and that upper end 61 of breech release lever 63 may engage breech latch 53 indirectly, only with tab 62 rather than with the direct action of tab 64. It is also possible to have interface member 200 dragged, rather than pushed, by upper end 61. Note further that as illustrated in FIG. 12, it is possible to have upper end 61 bear against lower plate 210 for a portion of upper end 61's forward motion, and then bear against breech latch 53 for the remainder of such motion to urge latch 53 clear of receiver body 57.

Conversion of a standard semi-automatic pistol into the preferred embodiment of the present invention is as follows. A slide action semi-automatic pistol, such as a Government .45 is field stripped, as is known, leaving the pistol frame 17 separate from the slide action barrel and slide assembly. The ammunition magazine or clip is removed by depressing button 20. The conversion is accomplished by first sliding the conversion barrel assembly (slide 15, barrel assembly 13, and pivot pin 43) onto mount 25 of frame 17. Note that slide 15 and barrel assembly 13 are to be already pivotally coupled by pin 43 prior to such mounting to mount 25. The mounting to mount 25 is accomplished by rearwards sliding of guideway **28*a* over rail 27, and of rail 30*a* in guideway 29. Note a corresponding set of rail-guideway engagements occur with guideway 28*b* and 30*b***.

After slide 15 is slid onto frame 17 until hole 33 aligns with hole 35, pin 37 is inserted in the holes to prevent longitudinal movement between the slide and the frame. Next, breech release actuator 19 (or alternatively breech release actuator 819) is inserted upwardly into magazine well 75 until in locks into place like a conventional clip. The conversion is thus complete, and the pistol ready to be operated.

To operate pistol 11, the user begins with a pistol as shown in FIG. 1. Next, the pistol is loaded by depressing plunger 71, causing upper end 61 to release latch 53. Simultaneously, downward pressure is exerted on the muzzle end of the barrel, causing the barrel assembly to pivot about pivot 43. This exposes breech surface 51 as shown in FIG. 6. A single round of ammunition is inserted in the breech with the rim of the cartridge nesting against rim ejector 77. This is the load position as shown in FIGS. 2 and 6. Next, the barrel assembly is positioned in the firing position as shown in FIGS. 1 and 4 by pressing downwardly on the breech end of the barrel until latch 53 snaps into engagement under receiver body 57. This entire process is done with breech release actuator 19 in place in magazine well 75. The hammer 87 is cocked backwards with all safeties (as known in the art) in firing position. Pistol 11 is then aimed at an appropriate target and discharged by the operator using trigger/hammer assembly 21 to cause firing pin 59 to activate the round of ammunition as is conventionally known. The spent cartridge in the breech of barrel 45 is then removed by depressing plunger 71 while pivoting barrel assembly 13 about pivot 43. The camming action between surface 81 and member 83 causes arm 79 and ejector 77 to move rearward with respect to barrel 45. This rearward movement of ejector 77 totally, or at least partially, ejects the spent cartridge from the breech of the barrel. With the cartridge removed, the pistol is ready to be reloaded with a second round of ammunition.

The present invention may be sold in a kit including barrel assembly 13, slide assembly 15 and breech release actuator 19. Such a kit may be readily used to convert a conventional semi-automatic pistol into a breech load pistol, well-suited for target shooting. The purchaser is saved the expense of buying an entirely new frame and consequently saves money.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A breech load firearm comprising:

a frame assembly having a trigger/hammer assembly including a trigger, a grip, and receiver body;

a barrel assembly coupled to said frame assembly and including a barrel having a muzzle end and a breech end having a rearward facing breech surface, said barrel having a bore therein defining a central barrel centerline; and means for reinforcing said receiver body of said frame assembly including a reinforcing portion of said frame assembly tapered from an upper rearward location which is adjacent said breech surface and which is above said barrel centerline and which is behind said trigger on said receiver body to a lower forward location which is below said barrel centerline and which is in front of said trigger on said frame assembly, wherein said reinforcing portion provides strength and rigidity increasing along said frame from said lower forward location to said upper rearward location to resist flexure of said frame.

2. The firearm of claim 1 wherein said barrel is pivotable with respect to said frame assembly between a firing position and a loading position.

3. The firearm of claim 2 wherein said firearm comprises a pistol.

4. The firearm of claim 3 wherein said frame assembly includes a frame and a slide, wherein said slide is mounted to said frame rigidly to prevent movement of said slide with respect to said frame during firing of the firearm, and wherein said slide is removable from said frame, and wherein said barrel is pivotally mounted to said slide.

5. The firearm of claim 4 wherein said bore is rifled and has a large bore diameter for receiving high power ammunition creating high bending stress forces in said frame assembly.

6. The firearm of claim 1 wherein said firearm comprises a pistol.

7. The firearm of claim 1 wherein said frame assembly includes a frame and a slide, wherein said slide is mounted to said frame rigidly to prevent movement of said slide with respect to said frame during firing of the firearm, and wherein said slide is removable from said frame, and wherein said barrel is pivotally mounted to said slide.

8. The firearm of claim 1 wherein said bore is rifled and has a large bore diameter for receiving high power ammunition creating high bending stress forces in said frame assembly.

9. A breech load firearm comprising:

a frame assembly having a trigger/hammer assembly, a grip, and receiver body;

a barrel assembly coupled to said frame assembly and including a barrel having a muzzle end and a breech end having a rearward facing breech surface, said barrel having a bore therein defining a central barrel centerline; and means for reinforcing said receiver body of said frame assembly including a reinforcing portion of said frame assembly tapered from an upper rearward location which is adjacent said breech surface and which is above said barrel centerline on said receiver body to a lower forward location which is below said barrel centerline on said frame assembly, wherein said reinforcing portion provides strength and rigidity increasing along said frame from said lower forward location to said upper rearward location to resist flexure of said frame, and wherein said bore is rifled and has a large bore diameter for receiving high power ammunition creating high bending stress forces in said frame assembly.

10. The firearm of claim 9 wherein said firearm comprises a pistol.

11. The firearm of claim 10 wherein said barrel is pivotally mounted to said frame assembly.

* * * * *